United States Patent [19]

Meyer

[11] 4,138,324

[45] Feb. 6, 1979

[54] METAL LAMINATE STRIP CONSTRUCTION OF BIPOLAR ELECTRODE BACKPLATES

[75] Inventor: Lewis M. Meyer, Painesville, Ohio

[73] Assignee: Diamond Shamrock Corporation, Cleveland, Ohio

[21] Appl. No.: 851,427

[22] Filed: Nov. 14, 1977

Related U.S. Application Data

[62] Division of Ser. No. 640,646, Dec. 15, 1975, Pat. No. 4,059,216.

[51] Int. Cl.[2] ..... C25B 1/08; C25B 11/03; C25B 11/10

[52] U.S. Cl. ..... 204/284; 204/254; 204/255; 204/256; 204/268; 204/290 F

[58] Field of Search ..... 204/268, 290 R, 290 G, 204/254, 255, 256, 284, 290 F, 290 G

[56] References Cited

U.S. PATENT DOCUMENTS

| | | | |
|---|---|---|---|
| 3,813,326 | 5/1974 | Gunby | 204/268 |
| 3,824,173 | 7/1974 | Bouy et al. | 204/284 |
| 3,859,197 | 1/1975 | Bouy et al. | 204/284 |
| 3,915,833 | 10/1975 | Michalek et al. | 204/254 |
| 3,977,958 | 8/1976 | Caldwell et al. | 204/252 |

*Primary Examiner*—F. C. Edmundson
*Attorney, Agent, or Firm*—Bruce M. Winchell

[57] ABSTRACT

Disclosed is a method for electrically and mechanically connecting the backplates of a bipolar electrode to be used in a filter press electrolytic cell for electrochemical production. This method employs the use of a metal laminate strip having surfaces of metallic substances identical and corresponding to the metallic makeup of the given backplates which can be welded between the anode and cathode backplates using standard weldment procedures. The metal laminate strips are placed in a spaced series such that the anode and cathode backplates present two parallel planes in spaced relation to each other thereby leaving a space for the escape of hydrogen gas, preventing hydrogen embrittlement of the titanium anode backplate.

4 Claims, 2 Drawing Figures

METAL LAMINATE STRIP CONSTRUCTION OF BIPOLAR ELECTRODE BACKPLATES

BACKGROUND OF THE INVENTION

This is a division, of application Ser. No. 640,646, filed Dec. 15, 1975 now U.S. Pat. No. 4,059,216.

The present invention relates generally to an electrolytic cell of the filter press type wherein a series of bipolar electrodes with diaphragms or membranes sandwiched in between can be used for electrochemical production of alkali metal hydroxides and halogens. More particularly, the present disclosure relates to an improved method for connecting the backplates of the bipolar electrodes by welding a metal laminate strip therebetween to provide the essential electrical and mechanical connection while leaving sufficient air space to allow hydrogen gas to escape from within the cell, preventing hydrogen embrittlement of the titanium anode backplate.

Chlorine and caustic (sodium hydroxide) are essential and large volume commodities which are basic chemicals required in all industrial societies. They are produced almost entirely by the electrolysis of aqueous solutions of alkali metal chlorides, with a major proportion of current production coming from the diaphragm type electrolytic cells. These cells generally have a plurality of electrodes disposed within the cell structure to present a plurality of rows of alternatively spaced anodes and cathodes. These electrodes are generally foraminous in nature and made of a mesh or expenaded metal material so that a hydraulicly permeable diaphragm may be formed over the cathode. This compartmental cell structure allows fluid flow through the cell. Brine (sodium chloride solution) starting material is continuously fed into the cell through the anode compartment and flows through the diaphragm backed by the cathode. To minimize back-diffusion and migration through the hydraulically permeable diaphragm, the flow rate is always maintained in excess of the conversion rate so that resulting catholyte solution has unreacted alkali metal chloride present. This catholyte solution, containing sodium hydroxide, unreacted sodium chloride, and certain other impurities, must then be concentrated and purified to obtain a marketable sodium hydroxide commodity and a sodium chloride solution to be reused in the diaphragm electrolytic cell. This is a serious drawback since the costs of this concentration and purification process are rising rapidly.

With the advent of technological advances such as the dimensionally stable anode which permits ever narrowing gaps between the electrodes and the hydraulically impermeable membrane, other electrolytic cell structures are being considered. The geometry of the diaphragm cell structure makes it inconvenient to place a planar membrane between the electrodes, hence the filter press electrolytic cell structure with planar electrodes has been proposed as an alternate electrolytic cell structure.

A filter press electrolytic cell is a cell consisting of several units in series, as in a filter press, in which each electrode, except the two end electrodes, acts as an anode on one side and a cathode on the other, and the space between these bipolar electrodes is divided into anode and cathode compartments by a membrane. In a typical operation, alkali metal halide is fed into the anode compartment where halogen gas is generated at the anode. Alkali metal ions are selectively transported through the membrane into the cathode compartment, and combine with hydroxyl ions generated at the cathode by the electrolysis of water to form the alkali metal hydroxides. In this cell the resultant alkali metal hydroxide is sufficiently pure and concentrated to be commercially marketable, thus eliminating an expensive second step of processing. Cells where the bipolar electrodes and the diaphragms or membranes are sandwiched into a filter press type construction may be electrically connected in series, with the anode of one connected with the cathode of an adjoining cell through a common structural member of partition. This arrangement is generally known as a bipolar configuration. A bipolar electrode is an electrode without direct metallic connection with the current supply, one face of which acts as an anode and the opposite face as a cathode when an electric current is passed through the cell.

While the bipolar configuration provides a certain economy for electrical connection of these electrodes in series there is a serious problem with the corrosion of cell components in contact with the anolyte. The anolyte normally contains highly corrosive concentrations of free halide, and the use of base metals such as iron to contain the solution have proven to be ineffective.

Proposals to overcome this problem include utilizing valve metals or alloys thereof to contain anolyte, either by fabricating an entire electrode from such a corrosion resistant material or by bonding a coating of valve metal onto a base metal within the anolyte compartment. The use of large quantities of expensive valve metals in commercial cell construction though has proven to be economically undesirable. The coated base metals on the other hand are prone to distintegration by peeling off of the protective layer and have also proven ineffective. It has been found that use of an air space between the backplates will act as an insulation against hydrogen ion travel and the resulting hydrogen embrittlement, because the hydrogen ions combine to form molecular hydrogen more readily than the ions move through the air space. Molecular hydrogen can then be simply vented off. This provides a convenient means for solving the embrittlement problem but leaves the problem of properly connecting the backplates in parallel spaced relation to each other. Welding would be ideal except that heretofore only insufficient methods were available for welding different metallic materials together such as steel and titanium.

Electrical and mechanical connection of these bipolar electrodes has been accomplished by internal bolting systems wherein the electrode is bolted through one pan, providing a spaced relation by use of a spacer of some sort, and through the second pan to the other electrode. Another method employs the use of an external bus-bar, outside of the electrolytic cell structure. Electrical connections made by the internal bolting systems are undesirable because elaborate sealing schemes are necessary to prevent electrolyte leakage which could result in an extreme corrosion of the cathode compartment. This increases the cell costs and necessitates frequent maintenance. Electrical connections made externally are also not desirable since larger power losses are occasioned by the added structural voltage drops.

Thus it has become exceedingly advantageous to provide a method for connecting the bipolar electrode backplates in a spaced relation at a commercially viable cost.

SUMMARY OF THE INVENTION

It is therefore an object of the present invention to provide a bipolar electrode which is capable of insertion into a filter press electrolytic cell that will have a greatly simplified means of connecting the two backplates to provide a bipolar electrode capable of withstanding commercial electrochemical production at a significantly reduced manufacturing cost.

It is another object of the present invention to provide an improved method for electrically and mechanically connecting the anode and cathode backplates of a bipolar electrode wherein a good current efficiency is achieved such commercial electrochemical production would be facilitated thereby.

These and other objects of the present invention, together with the advantages thereof over existing and prior art forms which will become apparent to those skilled in the art from the detailed disclosure of the present invention as set forth hereinbelow, are accomplished by the improvements herein shown, described and claimed.

It has been found that the anode and cathode backplates of a bipolar electrode for use in a filter press electrolytic cell can be connected mechanically and electrically by placing a spaced series of metal laminate strips of identical and corresponding metallic makeup to the metallic makeup of the corresponding backplates upon one of said backplates, placing the other backplate in direct allgnment on top of this space series of metal laminate strips such that the backplates present two parallel planes in spaced relation to each other, and effecting a weldment between the spaced series of metal laminate strips and each of the backplates.

One preferred embodiment of the improved method for mechanically and electrically connecting the backplates of a bipolar electrode is shown by way of example in the accompanying drawings without attempting to show all of the various forms and modifications in which the invention might be embodied; the invention being measured by the appended claims and not by the details of the specification.

DESCRIPTION OF THE PREFERRED EMBODIMENTS

Figure 1:
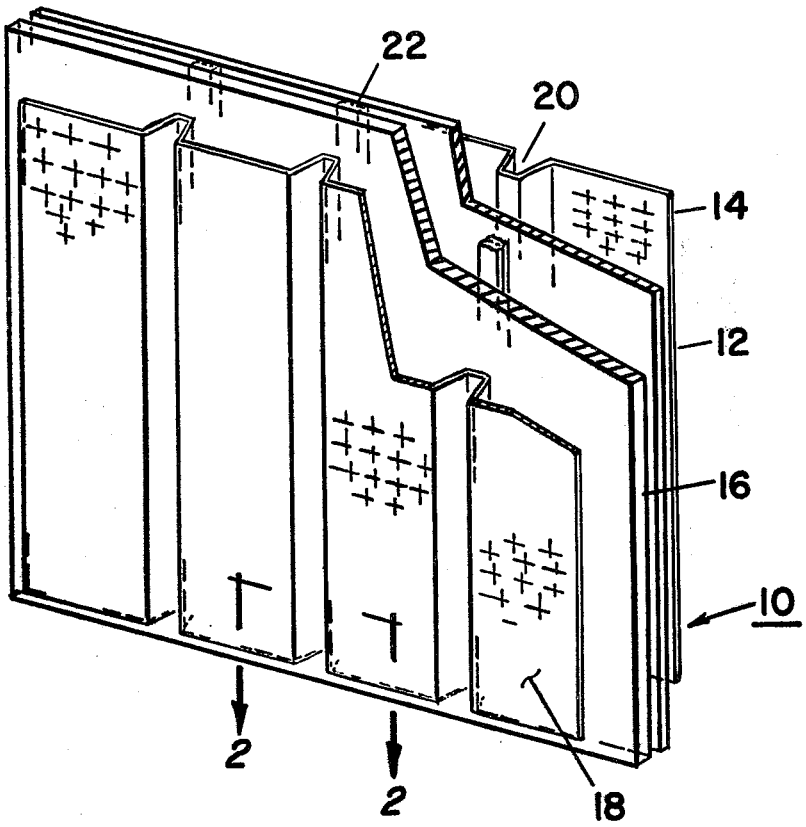
FIG. 1 is a perspective view of the anode and cathode pans of a bipolar electrode with the mechanical and electrical connection effected therebetween by the use of a space series of laminate metal strips welded therebetween according to the concepts of the present invention.
Figure 2:
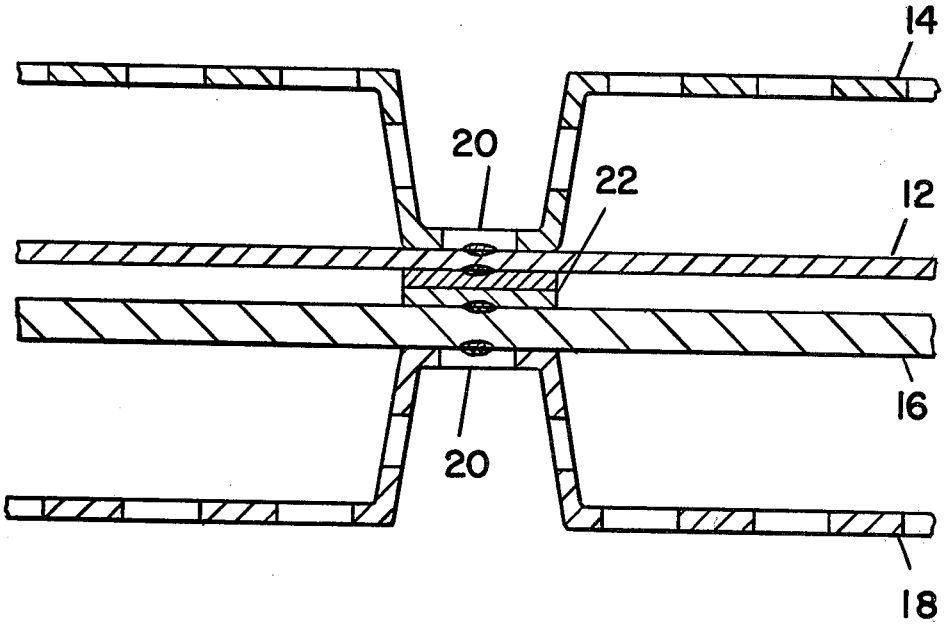
FIG. 2 is a partial side section view of a bipolar electrode taken substantially along line 2—2 of FIG. 1.

Referring to the drawings numeral 10 refers generally to a bipolar electrode assembled according to the concepts of the present invention. The bipolar electrode 10 is made up of an anode backplate 12 to which is connected an anode 14 and a cathode backplate 16 to which is connected a cathode 18. Around the outer perimeter of the anode backplate 12 and cathode backplate 16 would be an appropriate frame or other means for clamping the bipolar electrode 10 into a filter press electrolytic cell not shown. The details of this environmental structure have not been shown for ease of illustrating the concepts of the present invention. The anode backplate 12 and cathode backplate 16 could have just as easily each been made from single sheets of material so as to form a panlike structure providing a flange around the peripheral edge of each backplate such that the series of bipolar electrodes 10 might be clamped into a filter press electrolytic cell in liquid tight sealing engagement. The anode 14 and cathode 18 are generally foraminous in nature and can be made of a mesh or expanded metal material of appropriate metallic substance. Such foraminous anodes 14 may be made of any conventional electrically conductive electrolytically active material resistant to the electrolyte such as graphite or more preferably what is known in the art as dimensionally stable anodes. Such dimensionally stable anodes have an electro-conductive surface, e.g., a platinum group metal, an oxide of an platinum group metal, an anolyte resistant conductive oxide of a metal, and anolyte resistant conductive oxide of several metals, or the like on a valve metal base. The valve metals are those metals which form non-conducting oxides which are resistant to the anolyte when exposed thereto. The valve metals include titanium, zirconium, hafnium, vanadium, niobium, tantalum and tungsten. The foraminous anode 14 shown in FIG. 1 is generally preferred because their greater electrolytically active surface areas facilitate the electro-chemical reaction and the flow within the electrolytic cell. Generally the anode backplate 12 and anode 14 will be made of the same material such that conventional weldments may be accomplished between the anode backplate 12 and anode 14 as seen in FIG. 1. Th term "conventional weldments" is meant to include: soldering, brazing, arc welding, tig welding, tig with metal added or mig welding, and resistance or spot welding among other methods of welding. The cathode 18 also foraminous in nature may be made of any conventional electrically conductive material resistant to the catholyte, examples being iron, mild steel, stainless steel, MONEL containing 70 percent nickel and 30 percent copper, nickel and the like. The cathode backplate 16 is likewise made of the same material as the cathode 18 such said conventional weldments may be accomplished between the cathode 18 and cathode backplate 16. The anode backplate 12 will generally have a thickness of 0.020 to 0.125 inch (0.508 to 3.175 mm) when titanium is used for the backplate. The cathode backplate is generally a supporting structure for the bipolar electrode and is slightly thicker being in the thickness range of 0.080 to 0.75 inch (2.032 to 19.05 mm) especially when steel is used.

This results in a bipolar electrode 10 which has structural integrity due to the heavier steel plate used for the cathode backplate 16 while making an economical and efficient use of the chemically resistant titanium for the anode backplate 12. Titanium is a desirable valve metal for use in the anode 14 and anode backplate 12 because the anode compartment of an electrolytic cell contains an anolyte which normally has highly corrosive concentrations of free halide which can cause corrosion to most base metallic substances. As seen in the drawings the foraminous anode mesh 14 and foraminous cathode mesh 18 are both formed with channels 20 along their length such that convenient points are presented for weldment thereof to the backplates. Numerous other means for connecting the anode 14 and cathode 18 to the anode backplate 12 and cathode backplate 16 respectively have been proposed, including the use of riser posts of the same metal to span the gap between a planar electrode and a planar backplate.

Since it is believed that hydrogen ions generated at the cathode 18 migrate to the anode backplate 12 and anode 14 causing hydrogen embrittlement, it is necessary to leave some kind of barrier to these ions between the anode backplate 12 and the cathode backplate 16. Any insulative material can be used which will resist the flow of atomic hydrogen therethrough and it has been found that air provides such an insulative property since the hydrogen generally combines to form molecular hydrogen which is vented off before the hydrogen ions reach the cathode backplate 16. Copper is a second example of a good insulative material that effectively resists the flow of atomic hydrogen therethrough. To provide this kind of insulative barrier, a means of mechanically and electrically connecting the anode backplate 12 to the cathode backplate 16 in a spaced relation is desirable. This can be accomplished by placing between the anode backplate 12 and cathode backplate 16 a spaced series of laminate metal strips 22. A sufficient number are used, such that 5 to 10 percent of the total surface area of the two backplates is in direct bonded contact for the electrical current to be transmitted therethrough. The remaining space can be filled with insulative material or an air space can be left to allow the venting of hydrogen to prevent hydrogen embrittlement of the titanium backplate. The laminate metal strips 22 must be substances capable of carrying the necessary amount of electrical current while providing an insulator against hydrogen ion movement. In addition, the laminate metal strips must be a sandwich of two or more metallic substances such that one surface thereof will be of identical metallic makeup to correspond to the anode backplate 12 and the other surface thereof being of identical and corresponding makeup as the cathode backplate 16. An example of this would be a laminate metal strip 22 made of a sandwich of titanium to match the titanium used for the anode backplate 12 and steel on the other side to match the cathode backplate 16 made of steel as seen in the drawings. In addition to each surface of the metal laminate strips 22 being identical and corresponding to the respective backplate, the metals of the metal laminate strips 22 must be compatible for some kind of effective bonding to one another or some intermediate metal compatible to each must be inserted therebetween to make up a three metal laminate. One example of incompatible materials is tantulum and steel. Metal laminate strips 22 for this combination can be made with copper sandwiched in between the tantulum and steel since copper is compatible with both tantulum and steel for effective bonding.

Use of the laminate metal strips 22 reduces the connection of the anode backplate 12 and cathode backplate 16 to a standard process of conventional welding between each backplate and the laminate metal strip 22. This drastically simplifies the operation of such connection while eliminating the need to pierce either of the backplates, which heretofore has presented a sealing problem. The bipolar electrode 10 may, for instance, be assembled by putting the anode 14 and anode backplate 12 together with the metal laminate strip 22 and effecting a spot weld along the various positions of the metal laminate strips 22 in a single pass through standard spot welding machinery. Thereafter the cathode 18 and cathode backplate 16 may be similarly joined with the metal laminate strips 22 conveniently along these strips such that an excellent mechanical and electrical connection therebetween is effected. This eliminates the need for the use of any studs or other materials which must be pressed through the backplates and also the sealing problems that go along with such methods.

In actual practice it has been found the electrical energies necessary for weldments of the various materials require a stepwise assembly operation. First the metal laminate strips 22 are welded to one backplate and then to the second backplate. Then the foraminous electrode materials are individually welded to their respective backplates. The only likely short cut to this procedure would be to simultaneously weld the metal laminate strips 22 and the foraminous electrode material to one of the backplates and then repeat the process for the second backplate.

Metal laminate strip 22 materials are available commercially in sheet form and coil form of varying widths from a number of manufacturers and can be either of the roll bonded variety or explosion bonded variety as long as the metals can be integrally bonded together such that identical and corresponding metals will be facing each backplate. Several manufacturers produce these materials in sheet form to specification with whatever metals are to be used for the respective backplates. These sheets can then be cut into strips of convenient widths to be used in the method of the present invention. Such composite materials made of steel and titanium are readily available.

Thus it should be apparent from the foregoing description of the preferred embodiment, that the method hereinshown and described accomplished the objects of the invention and solves the problems attendant to such methods in the past.

What is claimed is:

1. A bipolar electrode assembly for use in an electrolytic cell comprising: a foraminous titanium anode bearing upon the surface thereof an electrocatalytically active, corrosive resistant material; a planar solid titanium anode backplate connected to said foraminous titanium anode in a spaced apart parallel relation thereto by virtue of a series of channels formed in said foraminous titanium anode material; a spaced series of metal laminate strips having one face made of titanium and the opposing face made of steel connected to said planar solid titanium anode backplate on the titanium face; a planar solid steel cathode backplate connected to the steel face of said spaced series of metal laminate strips; and a foraminous steel cathode connected to said planar solid steel cathode backplate in a spaced apart parallel relation thereto by means of a series of channels formed in said foraminous steel cathode, such that between 5 and 10 percent of the total surface area of said planar solid titanium backplate and said planar solid steel cathode backplate are in direct bonded contact to provide electrical current transmission therethrough while the remaining area is an air space to allow the venting of hydrogen to prevent the hydrogen embrittlement of the planar solid titanium anode backplate.

2. A bipolar electrode assembly according to claim 1 wherein said channels of said titanium anode and said steel cathode are connected to said titanium anode backplate and said steel cathode backplate respectively, in direct alignment with said spaced series of metal laminate strips.

3. A bipolar electrode assembly according to claim 1 wherein said spaced series of metal laminate strips have a central layer made of copper.

4. A bipolar electrode assembly for use in an electrolytic cell comprising: a foraminous tantalum anode having a spaced series of channels formed therein; a planar solid tantalum anode backplate connected to said foraminous tantalum anode in a spaced apart parallel relation thereto by means of the spaced series of channels formed in said foraminous tantalum anode; a spaced series of metal laminate strips having one face made of tantalum, the opposing face made of steel and a central portion made of copper connected to said planar solid tantalum anode backplate on the tantalum face; a planar solid steel cathode backplate connected to the steel face of said spaced series of metal laminate strips; and a foraminous steel cathode having a spaced series of channels formed therein connected to said planar solid steel cathode backplate in a spaced apart parallel relation thereto such that no more than 5 to 10 percent of the total surface area of said planar solid tantalum anode backplate and said planar solid steel cathode backplate are in direct bonded contact with said spaced series of metal laminate strips to provide electrical current transmission therethrough while the remaining area is an air space to allow the venting of hydrogen.

* * * * *